US005483130A

United States Patent [19]

Andreev

[11] Patent Number: 5,483,130

[45] Date of Patent: Jan. 9, 1996

[54] STRUCTURE FOR ACCELERATING HEAVY IONS WITH UNIFORMLY SPACED QUADRUPOLE FOCUSING (USQF)

[75] Inventor: Vladimir A. Andreev, Moscow, Russian Federation

[73] Assignees: Axelerator, Inc., Irvine, Calif.; Institute for Theoretical and Experimental Physics, Moscow, Russian Federation

[21] Appl. No.: 118,523

[22] Filed: Sep. 9, 1993

[30] Foreign Application Priority Data

Sep. 9, 1992 [SU] U.S.S.R. ..... 4165749

[51] Int. Cl.[6] ..... H01J 23/00

[52] U.S. Cl. ..... 315/505; 313/360.1; 315/5.42

[58] Field of Search ..... 328/233, 228, 328/234, 235, 236, 237; 313/359.1, 360.1, 62, 231.01; 315/5.42, 505, 506, 507

[56] References Cited

U.S. PATENT DOCUMENTS 4,490,648 12/1984 Lancaster et al. ..... 328/233 X 4,992,744 2/1991 Fujita et al. ..... 315/5.42 X

OTHER PUBLICATIONS

IEEE. Transactions on Nuclear Science, vol. NS–26, No. 3, Jun. 1979, pp. 3745–3747.

*Primary Examiner*—Sandra L. O'Shea

*Assistant Examiner*—Ashok Patel

*Attorney, Agent, or Firm*—Richard C. Woodbridge

[57] ABSTRACT

An accelerator for heavy ions includes four uniformly spaced, perpendicular electrodes with a height H, a length L, and a thickness t and wherein each electrode including at least two rectangular windows therein. Each window has a height b and a width W. The windows in each electrode are separated by a distance a and windows of adjacent electrodes are offset by a distance (W+a)/2 from each other. The accelerator is capable of resonating at relatively low frequencies and with relatively small diameters due to the enhanced coupling between chambers in the resonant cavity. The resonant frequency of the apparatus is approximated by the expression:

$$f = 1.385 \times 10^8 \sqrt{\frac{a+t}{(\pi H - 4t)[4b(W+a) + (a+t)\{H(4+\pi) - 4b\}]}}$$

5 Claims, 2 Drawing Sheets

STRUCTURE FOR ACCELERATING HEAVY IONS WITH UNIFORMLY SPACED QUADRUPOLE FOCUSING (USQF)

BACKGROUND OF THE INVENTION

1. Field of the Invention

The invention is related to a heavy ion accelerating apparatus and method, and, in particular, to the field of resonant accelerators and could be used for the design or reconstruction of operating accelerators.

2. Description of Related Art

There exist accelerating structures with USQF of the four chamber, H resonator type. They are typically used for accelerating light ions. See, for example, Potter, J. M. et al., IEEE Trans. Nucl. Science, NS-26, No. 3, 1979, p. 3745. High Frequency (HF) quadrupole focusing is provided by the generation of respective magnetic fields in the resonator's chambers, and an accelerating electric field is formed by modulation of electrodes.

Accelerating structures based on the principle of four chamber, H resonators, having high shunt impedance, are widely used in accelerating technology, though because their diameter is inversely proportional to their resonant frequency, they become impractical at frequencies lower than approximately 88 MHz, i.e. for the acceleration of heavy ions.

Another problem with such structures is weak coupling between the chambers, which is most characteristic of the case where the length of the accelerating structure (L) is much greater than the wave length (λ) of the HF filed. This results in the appearance of parasitic modes near the main oscillation mode, which requires special countermeasures to be taken to stabilize the HF fields.

SUMMARY OF THE INVENTION

Briefly described, the goal of the present invention is to improve the stabilization of the HF fields in a four chamber, H resonator accelerating structure and to decrease the dimensions of the latter, which will permit the acceleration of heavy ions.

The goal is reached by means of windows of width "W" cut into the electrodes, placed at a distance "a" from each other, and relatively shifted by a spacing of (W+a)/2 from adjacent perpendicular electrodes.

The use of the preferred structure can permit a 2.5 times diameter decrease while keeping the shunt impedance of the structure at a relatively high level. According to the prior art approach, at a frequency of 27 MHZ with a USQF four chamber type accelerating structure, the latter dimension would be 2.2 m, which is undesirable from the practical point of view.

The essential difference between the preferred structure and the known prior art types is the presence of rectangular windows in the electrodes of the four chamber, H resonators.

The invention may be more fully understood by reference to the following drawings.

DETAILED DESCRIPTION OF THE PREFERRED EMBODIMENT

During the course of this description, like numbers will be used to identify similar elements according to the different Figures that illustrate the invention.

Figure 1:
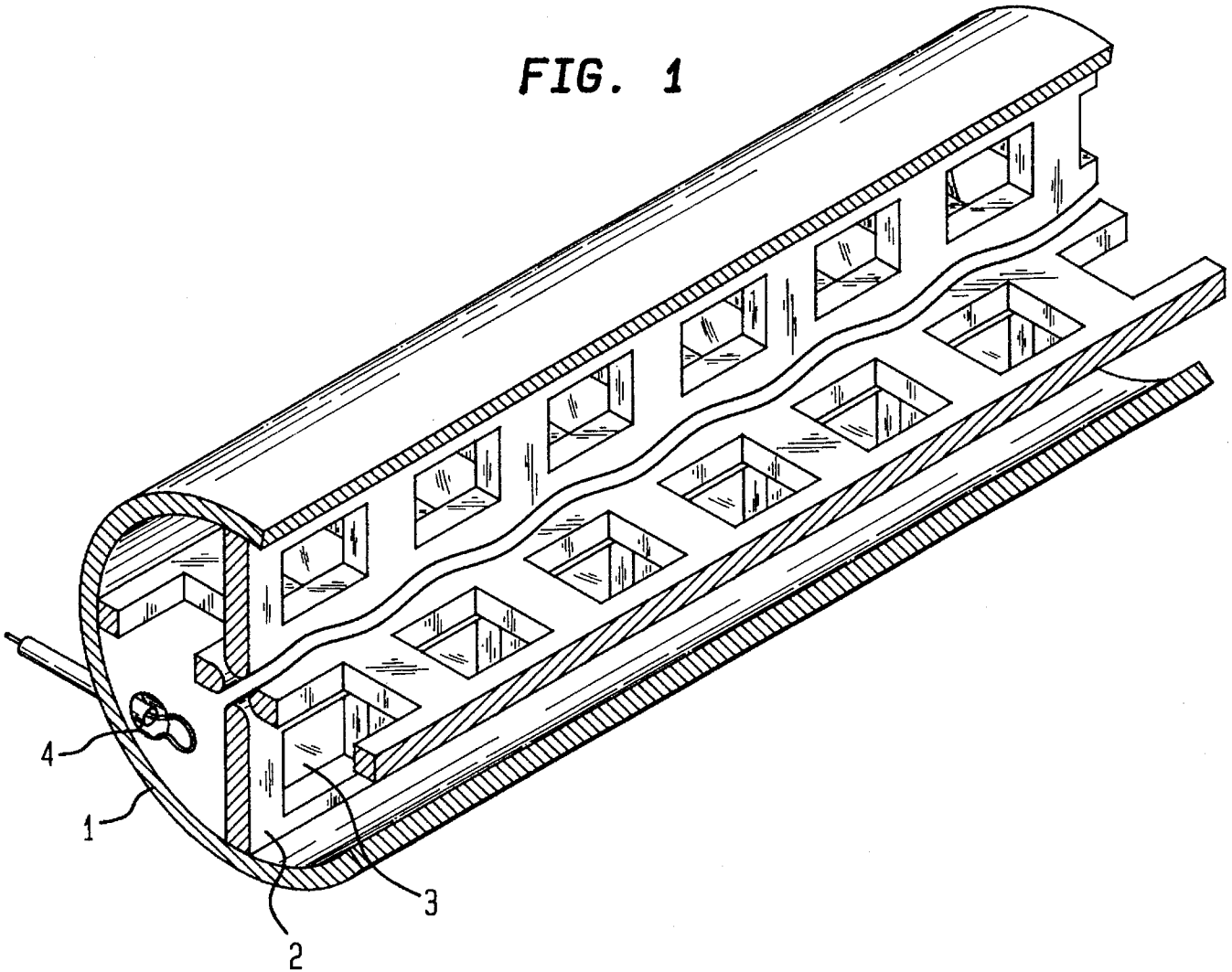
FIG. 1 is a partial cutaway perspective view of the preferred embodiment of the invention.
Figure 2B:
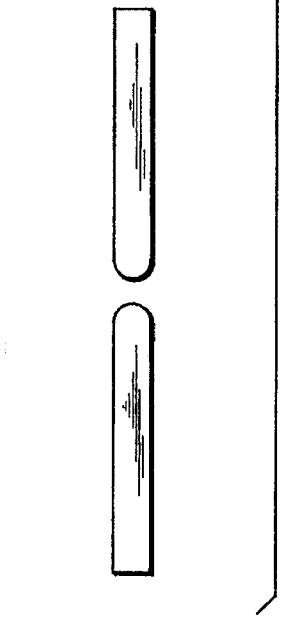
FIG. 2B is a side-elevation view of the elements illustrated in FIG. 2A.
Figure 2A:
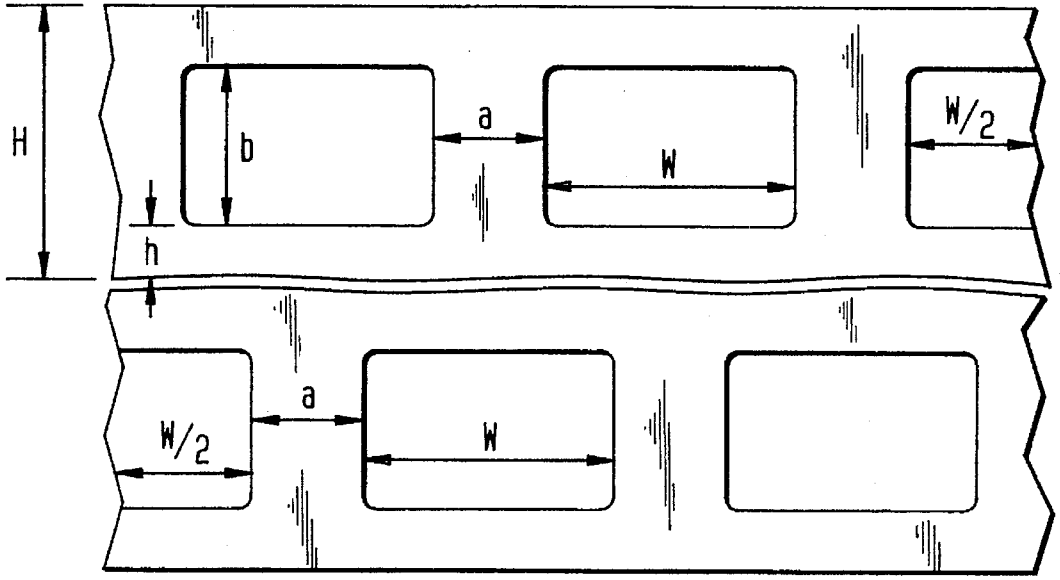
FIG. 2A is a schematic elevational view of the reciprocal location and geometric dimensions of the windows in two adjacent electrodes, one of which is turned 90° for the sake of clarity.

The elements that form the preferred embodiment of the invention, shown in FIG. 1, comprise: A cylindrical case (preferably vacuum tight) 1; four modulated electrodes 2, each having rectangular windows 3; and, part of the HF power injection apparatus 4. The end plates of the accelerating structures are not shown in FIG. 1.

The resonant frequency of the accelerator is defined by the relationship $\omega^2=1/L_cC_c$, where $L_c$=Inductance, which depends upon the electrode height (H), its thickness (t) and the geometric size of the windows 3, $C_c$=((W+a)/2)$C_t$=Capacitance, which depends upon the width of the window 3 (W), the distance between the windows 3 (a) and specific capacity of the channel ($C_t$), formed by the four electrodes 2, which in turn depend on radius of the electrode curvature (r), average radius of the channel aperture ($R_o$), and the amount of the electrode modulation (m).

In the case where $R_o$ and r are equal for practically all useful values, the resonant frequency of the accelerating structure is defined by the following approximate relationship:

$$f = 1.385 \times 10^8 \sqrt{\frac{a+t}{(\pi H - 4t)[4b(W+a) + (a+t)\{H(4+\pi) - 4b\}]}}$$

The accelerating structure operates in the following manner. Injection of HF energy through element 4 (see FIG. 1) causes the main magnetic HF fields to be generated in the chambers of the H resonator and electric fields in the space between electrodes 2 (i.e. in the accelerating channel). In order to produce the quadrupole HF field in the accelerating channel, the magnetic field in each chamber must be shifted in phase relative to the magnetic fields in two adjacent chambers by 180°. HF conduction current flows along the inner surface of the cylindrical case 1, the surface of the electrode 2 having the width "t", and the inner surface of the window 3, which creates magnetic fields coupling the adjacent chambers and ensures the suppression of undesirable dipole modes.

To test the feasibility of the preferred embodiment and to investigate different parameters of the accelerating structure, a prototype model was fabricated with the following geometrical dimensions:

| | |
|---|---|
| electrode 2 height (H) | 0.215 m |
| electrode 2 length (L) | 0.6 m |
| cylindrical shell 1 diameter (D) | 0.44 m |

-continued

| | |
|---|---|
| window 3 height (b) | 0.13 m |
| window 3 width (W) | 0.17 m |
| distance between windows 3 (a) | 0.07 m |
| structure radius ($R_o$) (electrodes are not modulated) | 0.003 m |
| radius of the electrode 3 curvature (r) | 0.003 m |

The electrodes 2 are preferably fabricated from aluminum and the cylindrical shell 1 from copper foil. The electrical contact between the electrodes 2 and the shell 1 is provided by thin copper foil strips, which are fastened to the electrodes 2 and the shell 1 by screws. In a fully operational model, the construction of the contacts would be provided by conventional welding or soldering.

The results of the test of the prototype are given in Table 1 below:

TABLE 1

| Parameters | Calculations | Measurements | Notes |
|---|---|---|---|
| Resonant frequency (MHz) | 115.8 | 116.3 | |
| Quality | 10500 | 4000 | Due to screw connections |
| The shunt impedance (kOhm m) | 225 | 90 | |
| The frequency of the dipole modes (MHz) | — | 136.6<br>134.95 | |
| Distribution of the HF field measured between, electrodes | — | < 1% | |

The results obtained clearly show that the preferred accelerating structure as demonstrated by the prototype model has important advantages over the prior art. The presence of distantly located dipole modes provides for increased stabilization of the fields due to the enhanced coupling between the chambers of the structure.

The application of the inventive concept permitted the resonator diameter to decrease by almost 1.5 times (a four chamber-type resonator where D=0.6 m). The prototype model demonstrates that the general inventive concept is correct and it is anticipated that even better results could be obtained with further effort.

While the invention has been described with reference to the preferred embodiment thereof, it will be appreciated by those of ordinary skill in the art that various changes can be made to the structure and method of the invention without departing from the spirit and scope of the invention as a whole.

What is claimed is:

1. An accelerating apparatus for accelerating heavy ions inside a case defining a channel and including four electrodes therein and a means for injecting HF power into said case, said apparatus comprising:

window means in each of said four electrodes, said window means comprising at least two windows each having a height b and a width W, and wherein each window is separated from its nearest neighbor window in each electrode by an edge-to-edge distance a and further wherein adjacent electrodes are perpendicular to each other and further wherein said windows in adjacent electrodes are offset from each other by a distance (W+a)/2.

2. The apparatus of claim 1 wherein said apparatus comprises a Uniformly Spaced Quadrupole Focusing (USQF) apparatus.

3. The apparatus of claim 1 wherein said channel is substantially evacuated.

4. The apparatus of claim 3 wherein said windows are rectangular in shape.

5. The apparatus of claim 1 wherein said apparatus has an approximate resonant frequency of:

$$f = 1.385 \times 10^8 \sqrt{\frac{a+t}{(\pi H - 4t)[4b(W+a) + (a+t)\{H(4+\pi) - 4b\}]}}$$

wherein t=the thickness of said electrodes and, wherein H=the height of said electrodes.

* * * * *